US007347749B1

(12) United States Patent
Ju

(10) Patent No.: US 7,347,749 B1
(45) Date of Patent: Mar. 25, 2008

(54) ELECTRICAL CONNECTOR WITH PIVOTING TERMINAL

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/580,286

(22) Filed: Oct. 13, 2006

(51) Int. Cl.
*H01R 4/50* (2006.01)

(52) U.S. Cl. ..... 439/864

(58) Field of Classification Search ..... 439/862, 439/500, 80, 81, 82, 74, 864, 66, 91, 591
See application file for complete search history.

(56) References Cited

U.S. PATENT DOCUMENTS 5,716,230 A * 2/1998 Marren et al. ..... 439/500
5,746,626 A * 5/1998 Kwiat et al. ..... 439/630
5,975,916 A * 11/1999 Okura ..... 439/74
6,062,871 A * 5/2000 Arai et al. ..... 439/66
6,071,138 A * 6/2000 Walkup et al. ..... 439/266
6,234,835 B1 * 5/2001 Bakker et al. ..... 439/553
6,390,828 B1 * 5/2002 Yamaguchi et al. ..... 439/74
6,652,329 B1 * 11/2003 Howell et al. ..... 439/862
6,991,472 B2 * 1/2006 Du et al. ..... 439/66
2003/0190837 A1 * 10/2003 Wu ..... 439/500
2005/0130510 A1 * 6/2005 Zheng et al. ..... 439/862

* cited by examiner

*Primary Examiner*—Chandrika Prasad
(74) *Attorney, Agent, or Firm*—Troxell Law Office, PLLC

(57) ABSTRACT

The present invention discloses an electrical connector, comprising an insulating body provided with a plurality of accommodating passages; and an electrical terminal received in the accommodating passage and having a fastening portion on one side to fasten with the insulating body and a contact portion on the other side to be swingingly connected with. Compared with the conventional art, the electrical connector according to the present invention can maintain better resilience without loosening and thus ensure secure electrical connection with mating electronic components.

8 Claims, 3 Drawing Sheets

ELECTRICAL CONNECTOR WITH PIVOTING TERMINAL

FIELD OF THE INVENTION

The present invention relates to an electrical connector, and in particular to an electrical connector which is used to connect the land grid array (LGA) chip module to a circuit board.

BACKGROUND OF THE INVENTION

The conventional art of an electrical connector usually connects the LGA chip module to a circuit board, wherein the electrical connector usually comprises electrical terminals. U.S. Pat. No. 6,488,513 discloses an electrical connector which can provide densely spaced contact pads on both ends to compressingly contact with mating electronic components, comprising electrical terminals and an insulating body, wherein the electrical terminal is a C-shape comprising an upper and lower resilient contact arms as well as a body. The upper and lower resilient contact arms extend from the opposite sides of the insulating main body and the lower resilient arm is generally a shape of inclined slot whose end can be pressed against the metal contact of the electronic component (electrical circuit).

However, the drawback of the aforementioned US patent lies in the fact that the poor fatigue resistance of the electrical terminal will negatively affect the electrical connection with its mating electronic components when the resilience of the terminal diminishes after repetitive uses.

Consequently, it is necessary to design a new electrical connector to overcome the aforementioned drawback.

SUMMARY OF THE INVENTION

One object of the present invention is to provide an electrical connector which can ensure a secure electrical connection between two mating electronic components.

To achieve the aforementioned object, the electrical connector according to the present invention comprises an insulating body provided with a plurality of accommodating passages; and an electrical terminal received in the accommodating passage and having a fastening portion on one side to fasten with the insulating body and a contact portion on the other side to be swingingly connected with.

Compared with the conventional art, the electrical connector according to the present invention can maintain better resilience without loosening and thus ensure secure electrical connection with mating electronic.

BRIEF DESCRIPTION OF THE DRAWINGS

The present invention can be more fully understood by reference to the following description and accompanying drawings, in which.

DETAILED DESCRIPTION OF THE INVENTION

Figure 1:
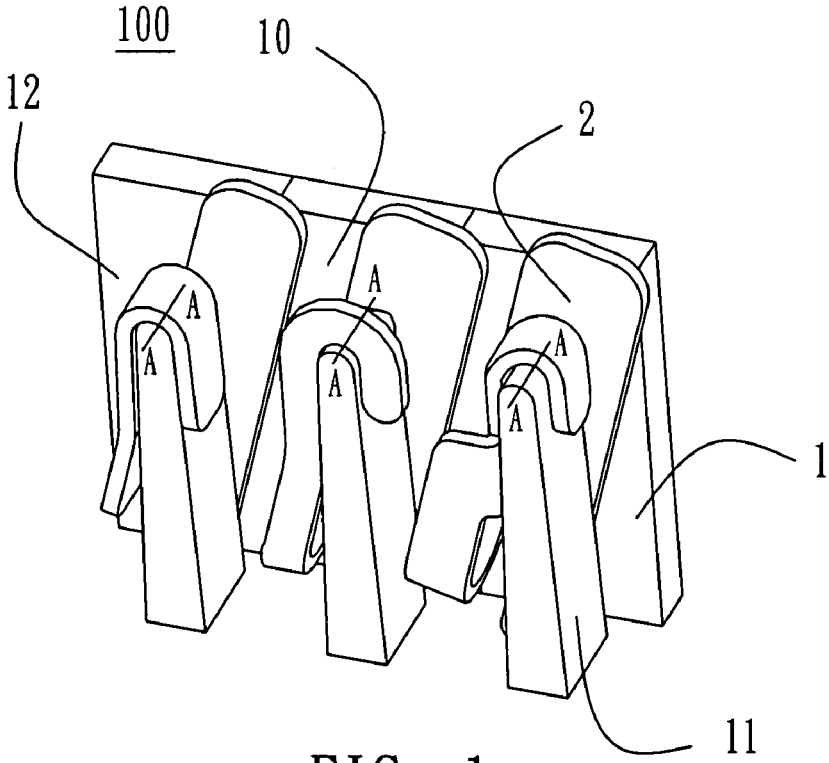
FIG. 1 schematically illustrates a perspective assembly view of a preferred embodiment of the electrical connector according to the present invention.
Figure 2:
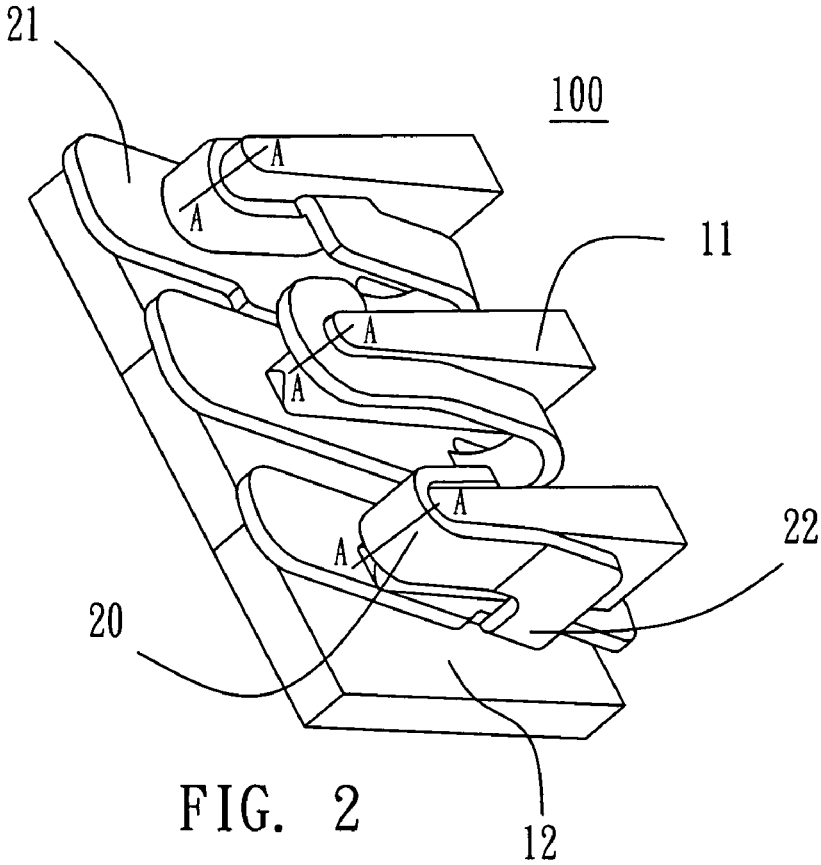
FIG. 2 schematically illustrates a local perspective view of the electrical connector in FIG. 1 from another view angle.
Figure 3:
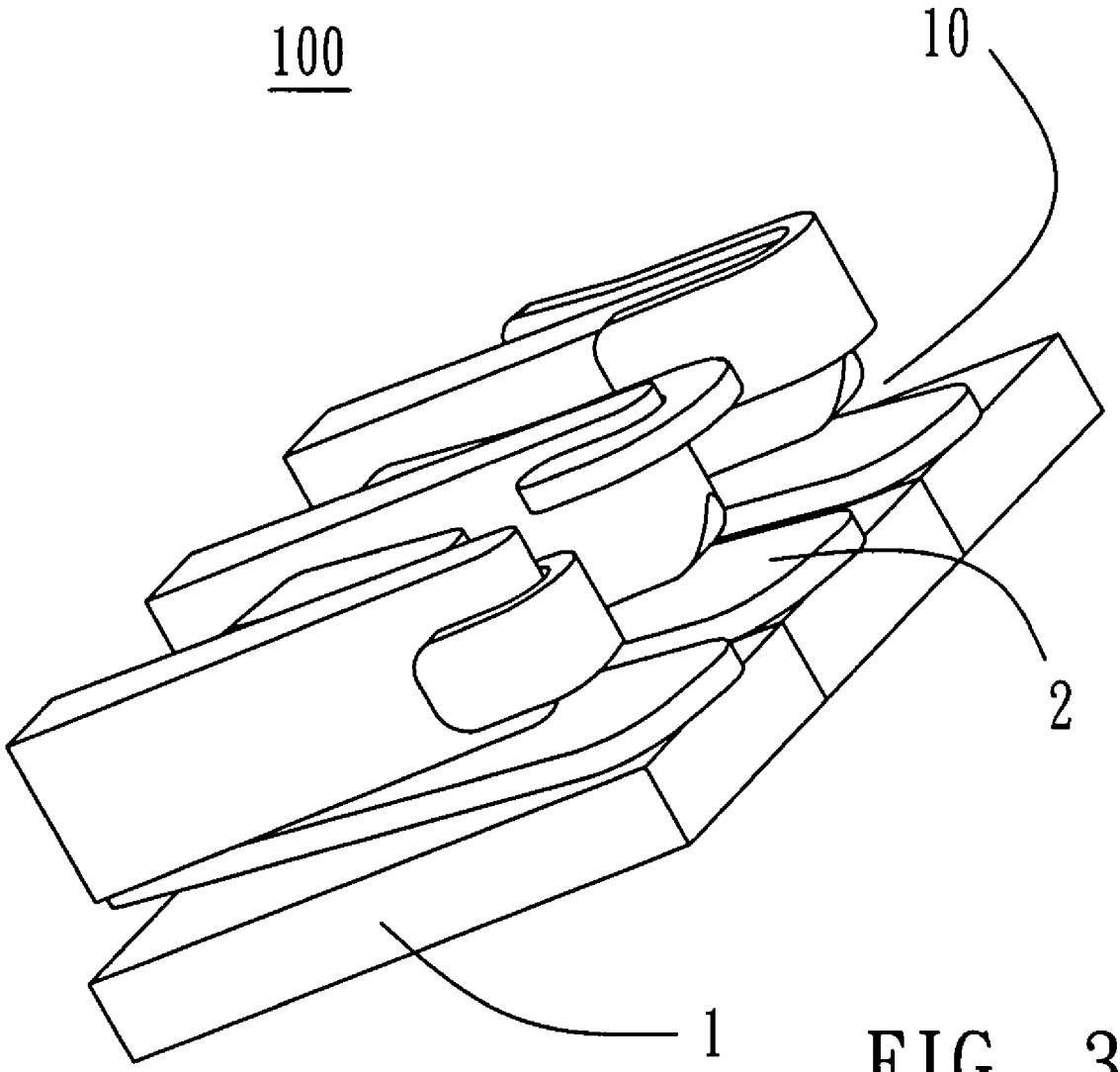
FIG. 3 schematically illustrates a local perspective view of the electrical connector in FIG. 1 from yet another view angle.

With reference to FIGS. 1 to 4, the electrical connector 100 according to the present invention is to establish electrical connection between two mating electronic components (or to electrically connect a Land Grid Array (LGA) chip module to a circuit board (both not shown); of course, the electrical connection can be for other mating electronic components, two circuit boards, for example). The electrical connector 100 according to the present invention comprises an insulating body 1 and a plurality of electrical terminals 2.

The insulating body 1 is provided with a plurality of accommodating passages 10, in which the electrical terminals 2 are received in the corresponding accommodating passages 10. The insulating body 1 is further provided with a plurality of locating portions 11 corresponding to the accommodating passages 10 to position and thus securingly fasten the electrical terminals 2 onto the insulating body 1. The locating portion 11 at its one end is formed to have a first contact surface 111. Further, the locating portions 11 divide the neighboring accommodating passages 10 and one part of the locating portions 11 keeps a certain distance from an internal wall 12 of the accommodating passages 10; whereas the other part of the locating portion 11 connects with one end of the insulating body 1.

Figure 4:
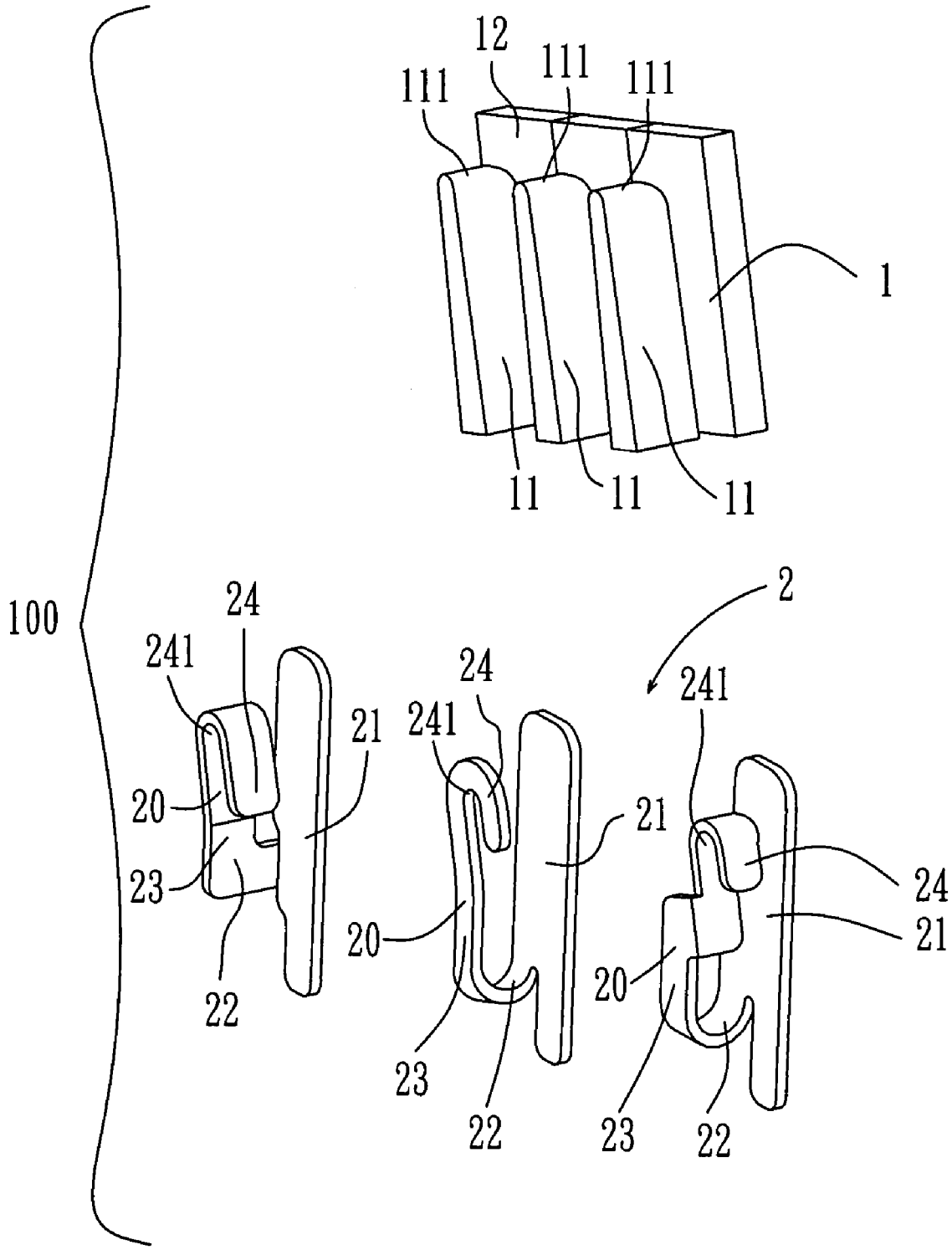
FIG. 4 schematically illustrates an exploded perspective view of the electrical connector in FIG. 1.

With reference to FIG. 4, the electrical terminals 2 having a strip shape formed by stamping metal strips are inserted into and fastened in the accommodating passages 10. The electrical terminals 2 received in the accommodating passages 10 have different shapes, yet each electrical terminal 2 comprises a connecting portion 22, a contact portion 21 extending from both ends of the connecting portion 22, and a fastening portion 20 formed by extending sideward, upward, and then bending downward from the middle of the connecting portion 22. (Of course, the electrical terminal may comprise a connecting portion, a contact portion extending from both ends of the connecting portion, and a fastening portion formed by bending upward, extending, and then bending downward from one end of the connecting portion; alternatively, the electrical terminal may comprise a connecting portion, a contact portion extending from both ends of the connecting portion, and a fastening portion formed by bending upward, extending, and then bending upward and downward from one end of the connecting portion, as shown in FIG. 4). The two contact portions 21 may be disposed on the same vertical direction (or may be alternatively disposed along the vertical direction. The fastening portion 20 and the contact portion 21 are disposed face to face and in parallel. Of course, the fastening portion 20 and the contact portion 21 may also be perpendicularly disposed. The connecting portion 22 is to connect the fastening portion 20 with the contact portion 21 and to provide the resilience of the contact portion 21.

The fastening portion 20 of each electrical terminal 2 comprises a base portion 23 connected to the connecting portion 22 and an arch-shape snap engagement portion 24 extending from the base portion 23. The snap engagement portion 24 at its bottom is provided with an arch-shape second contact surface 241. The areas of the base portions 23 and the second contact surfaces 241 of the electrical terminals 2 can be the same or different.

The snap engagement portion 24 is disposed at the locating portion 11 of the insulating body 1. Further, the second contact surface 241 of the snap engagement portion 24 is to encompass over the first contact surface 111 of the locating portion 11. Between the first contact surface 111 and the second contact surface 241 exists a junction line AA, which is a coplanar line of the arch surfaces of the first contact surface 111 and the second contact surface 241.

The contact portion 21 of each electrical terminal 2 is secured between the location portion 11 of the insulating body 1 and the inner wall 12 of the accommodating passage 10. When the mating electronic component is contacted with the contact portion 21 of the electrical terminal 2, the connecting portion 22 can provide sufficient resilience to render the contact portion 21 swinging about the junction line AA and thus the contact portion 21 of the electrical terminal 2 and the mating electronic move relatively over a certain distance to achieve a better electrical connection therebetween. When the mating electronic component is disengaged, the contact portion 21 of the electrical terminal 2 may return to original shape, also by swinging about the junction line AA, due to the resilience of the connecting portion 22.

Consequently, the electrical connector according to the present invention can maintain better resilience without loosening and thus ensure secure electrical connection with mating electronic components, which can overcome the drawbacks of the conventional art.

While the invention has been described with reference to the a preferred embodiment thereof, it is to be understood that modifications or variations may be easily made without departing from the spirit of this invention, which is defined by the appended claims.

What is claimed is:

1. An electrical connector comprising:

a) an insulating body having a plurality of accommodating passages, each accommodating passage of the plurality of accommodating passages has a locating portion having a first contact surface located on an end of the locating portion, the first contact surface having an arch shape; and b) a plurality of electrical terminals located in the plurality of accommodating passages, each of the plurality of electrical terminals has:

i) a fastening portion located on a first side thereof and having a second contact surface selectively connected to the first contact surface of the locating portion of a corresponding one of the plurality of electrical terminals, a junction line is formed between the first contact surface and the second contact surface; and ii) a contact portion located on a second side thereof and pivoting about the junction line.

2. The electrical connector according to claim 1, wherein the fastening portion and the contact portion are disposed face to face.

3. The electrical connector according to claim 1, wherein the fastening portion and the contact portion are disposed in parallel.

4. The electrical connector according to claim 1, wherein the electrical connector further comprises a connecting portion to connect the fastening portion with the contact portion.

5. The electrical connector according to claim 1, wherein the electrical terminal further comprises a connecting portion, a contact portion extending from both ends of the connecting portion, and a fastening portion formed by extending sideward, upward, and then bending downward from the middle of the connecting portion.

6. The electrical connector according to claim 1, wherein the electrical terminal further comprises a connecting portion, a contact portion extending from both ends of the connecting portion, and a fastening portion formed by bending upward, extending, and then bending downward from one end of the connecting portion.

7. The electrical connector according to claim 1, wherein the electrical terminal further comprises a connecting portion, a contact portion extending from both ends of the connecting portion, and a fastening portion formed by bending upward, extending, and then bending upward and downward from one end of the connecting portion.

8. The electrical connector according to claim 1, wherein the electrical connector further comprises two contact portions being alternatively disposed vertically.

* * * * *